United States Patent [19]

Schuite

[11] Patent Number: 4,973,021

[45] Date of Patent: Nov. 27, 1990

[54] SYSTEM FOR HANGING PICTURES AND THE LIKE

[76] Inventor: Johannes L. B. Schuite, P.O. Box 639, 2280 Ap Rijswijk, Netherlands

[21] Appl. No.: 802,487

[22] Filed: Nov. 27, 1985

[30] Foreign Application Priority Data

Nov. 28, 1984 [NL] Netherlands ..... 8403623

[51] Int. Cl.[5] ..... A47G 1/00

[52] U.S. Cl. ..... 248/495; 248/215; 248/327

[58] Field of Search ..... 248/495, 489, 493, 327, 248/339, 340, 215; 40/152.1

[56] References Cited

U.S. PATENT DOCUMENTS

| | | | |
|---|---|---|---|
| 234,609 | 11/1880 | Prescott | 248/495 |
| 779,433 | 1/1905 | Long | 248/495 |
| 989,612 | 4/1911 | Kohn | 248/495 |
| 1,107,686 | 8/1914 | Mehrmann | 248/495 |
| 1,196,936 | 9/1916 | Elsass et al. | 248/495 |
| 2,516,617 | 7/1950 | Coughlin | 248/215 X |
| 2,565,978 | 8/1951 | Meriwether | 248/327 |
| 3,424,422 | 1/1969 | Klangos | 248/215 |
| 4,549,713 | 10/1985 | Magadini | 248/495 |

FOREIGN PATENT DOCUMENTS

| | | | |
|---|---|---|---|
| 19688 | 9/1905 | United Kingdom | 248/495 |

*Primary Examiner*—David L. Talbott
*Attorney, Agent, or Firm*—Olson & Olson

[57] ABSTRACT

System for hanging pictures and the like, consisting of a carrier rail (1) to be secured horizontally to a wall, a wire (6) extending vertically, a hook-shaped element (3) at the top end of the wire (6) for connecting the wire (6) to the carrier rail (1) and an identical hook-shaped element (3) for connecting the wire (6) to hanging means at the back of the picture or the like, each hook-shaped element (3) being provided with a through channel (5) for allowing the wire (6) through, and having exclusively essentially the form of a rectangular parallelpiped with a slot (4) crossing perpendicularly the channel (5) for the wire (6) and adapted to cooperate with the carrier rail (1) and with the hanging means at the back of the picture or the like.

1 Claim, 1 Drawing Sheet

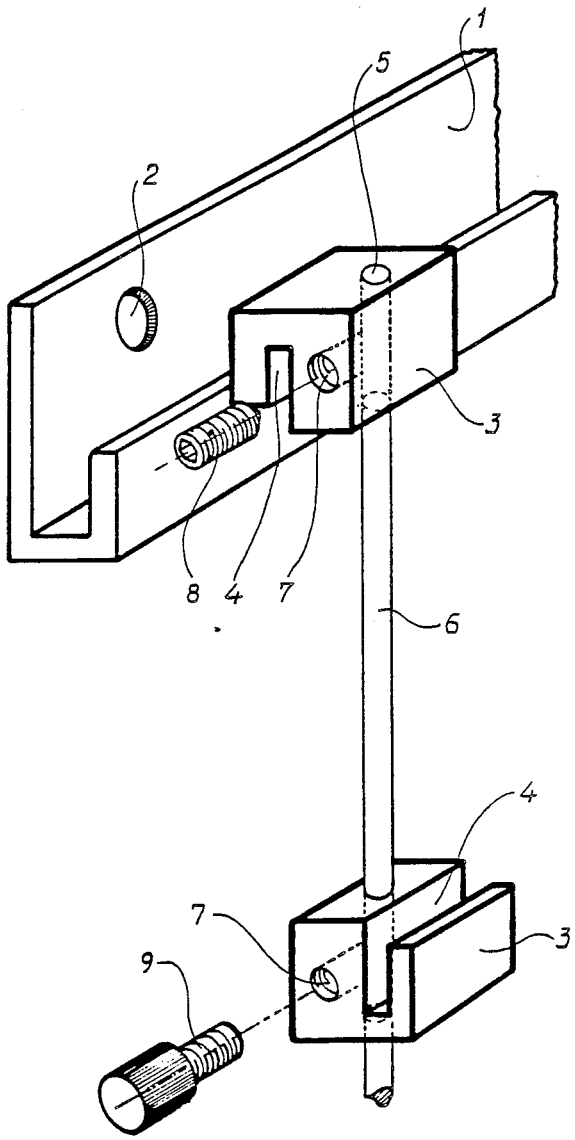
1
5
2
3
8
4
7
6
4
7
3
9

SYSTEM FOR HANGING PICTURES AND THE LIKE

BACKGROUND OF THE INVENTION

The invention relates to a system for hanging pictures and the like, consisting of a carrier rail to be secured horizontally to a wall, a wire extending vertically, a hook-shaped element at the top end of the wire for connecting the wire to the carrier rail and an identical hook-shaped element for connecting the wire to hanging means at the back of the picture or the like each hook-shaped element being provided with a through channel for allowing the wire through and with a channel crossing perpendicularly first-mentioned channel, provided with internal screw thread for receiving a clamping bolt engaging the wire.

Such a system is known from DE-U-7917482 and can be used in museums, and also in offices, private houses, schools, and the like to hang pictures, plates and the like as many desired place and at any desired height.

At this known system each hook-shaped element in fact consists of two separate parts, namely a double-bent hook and a clamping piece. The clamping piece rests in the hook.

SUMMARY OF THE INVENTION

According to the invention, this is achieved in that each hook-shaped element has exclusively essentially the form of a rectangular parallelepiped with a slot crossing perpendicularly the channel for the wire and adapted to cooperate with the carrier rail and with the hanging means at the back of the picture or the like.

The object of the invention is to perfect this system further, so that it will be cheaper, obtains a better appearance and it is easier to handle.

The foregoing and other objects and advantages of this invention will appear from the following detailed description taken in connection with the accompanying drawing of a preferred embodiment.

BRIEF DESCRIPTION OF THE DRAWINGS

The single FIGURE is a perspective view of a system for hanging pictures and the like embodying the features of this invention.

DESCRIPTION OF THE PREFERRED EMBODIMENT

1 indicates a section of a conventional rail which is intended to be secured to a wall of a building by means of screws or the like via holes 2.

In general, the rail 1 is secured along the upper edge of the wall facing the ceiling.

The profile of the rail 1 is essentially U-shaped in cross-section with a shorter frontmost leg.

A hook-shaped element 3 engages over the shorter frontmost leg.

This element has essentially the shape of a rectangular parallelepiped and is preferably made of metal such as aluminium.

In the small block 3 a groove 4 is present which fits over the foremost shorter leg of the rail 1.

The small block 3 is further provided with a through, preferably circularly cylindrical channel 5, through which a wire 6 of clear plastic material can be inserted.

Transversely to the channel 5 there runs a circularly cylindrical channel 7 at least partially provided with an internal screw thread, into which channel a small bolt 8 with a hexagonal socket head fits.

The wire 6 can be firmly clamped in the small block 3 by means of the small bolt 8 using a tool which fits therein.

Although the small block 3 and the bolt 8 preferably consist of metal, one or both of them may also be made of plastic.

The wire 6 does not need to project above the small block 3.

This same small block 3 is also used to secure a picture or the like to the wire 6.

In this case instead of a completely countersunk bolt 8 a bolt 9 is preferably used which can be tightened up by hand.

To hang a picture or the like one or two small blocks 3 are hooked onto the rail 1 with the wire or wires 6 already secured therein.

A small block 3 is slid onto each wire 6 and fixed at the correct height with the small bolt 9.

The section of the wire or each wire 6 projecting downwards can optionally be cut off although it is hidden behind the picture.

After hanging, only the uppermost small blocks 3 are visible which may have a matched colour. The crystal clear wires 6 are not noticeable.

In order to have an impression of the order of size of the small block 3, it is pointed out that a cube with edges of approx. 10 mm appears in practice to be satisfactory.

The plastic wire 6 is obtainable commercially. A favourable thickness is, for example, approx. 2 mm.

The system according to the invention is of course not only intended for pictures but all kinds of objects can be hung in this manner and indeed at any suitable height.

I claim:

1. A system for hanging pictures and the like, comprising (a) a carrier rail of U-shape cross section having a rear leg arranged to be secured to a wall and a front leg spaced forwardly of the wall and extending upwardly, (b) a pair of substantially identical blocks each having a transverse slot extending inwardly from one side and terminating inwardly of the opposite side, and a bore extending through the block between said one and opposite sides substantially parallel to the plane of said slot, (c) an elongated wire receivable through said bores, and (d) means for securing the wire to each block, (e) the transverse slot in one of said blocks facing downwardly and arranged to receive therein the front leg of the carrier rail for suspending the wire and the other of said blocks downwardly therefrom, and (f) the transverse slot in the other of said blocks facing forwardly and upwardly and arranged to receive therein means for hanging a picture or the like.

* * * * *